US011066937B2

(12) United States Patent
Guo et al.

(10) Patent No.: US 11,066,937 B2
(45) Date of Patent: Jul. 20, 2021

(54) CUTTING BLADE TIPS

(71) Applicant: United Technologies Corporation, Farmington, CT (US)

(72) Inventors: Changsheng Guo, South Windsor, CT (US); Christopher W. Strock, Kennebunk, ME (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 16/825,610

(22) Filed: Mar. 20, 2020

(65) Prior Publication Data

US 2020/0217209 A1 Jul. 9, 2020

Related U.S. Application Data

(63) Continuation-in-part of application No. 15/943,431, filed on Apr. 2, 2018, now Pat. No. 10,711,622, (Continued)

(51) Int. Cl.
*F01D 5/20* (2006.01)
*F01D 11/12* (2006.01)

(52) U.S. Cl.
CPC ..... *F01D 5/20* (2013.01); *F01D 11/122* (2013.01); *F05D 2220/32* (2013.01); (Continued)

(58) Field of Classification Search
CPC . F01D 5/20; F01D 5/34; F01D 11/122; F05D 2220/32; F05D 2230/10; (Continued)

(56) References Cited

U.S. PATENT DOCUMENTS 3,199,836 A 8/1965 Moyer
4,169,020 A 9/1979 Stalker et al.
(Continued)

FOREIGN PATENT DOCUMENTS

CN 1940306 A 4/2007
EP 2309097 A1 4/2011
WO 2011038971 A1 4/2011

OTHER PUBLICATIONS

Chinese Office Action from the Chinese Patent Office for CN Application 20150301455.1 dated Jan. 17, 2018, 18 pages, English Translation Included.

(Continued)

*Primary Examiner* — Igor Kershteyn
(74) *Attorney, Agent, or Firm* — Cantor Colburn LLP

(57) ABSTRACT

An integrally bladed rotor, including: a plurality of blades integrally formed with a hub as a single component, each of the plurality of blades having a blade body extending from the hub to an opposed blade tip surface along a longitudinal axis, wherein the blade body defines a pressure side and a suction side, and wherein the blade body includes a cutting edge defined between the blade tip surface of the blade body and the pressure side of the blade body, wherein the cutting edge is configured to abrade a seal section of an engine case. A method for manufacturing an integrally bladed rotor includes: forming a plurality of airfoils integrally with a hub to form a single component, each of the plurality of airfoils having an opposed tip surface with respect to the hub extending along a longitudinal axis, wherein each of the plurality of airfoils defines a pressure side and a suction side; and forming a cutting edge between the tip surface and the pressure side of each of the plurality of airfoils, wherein the cutting edge is configured to abrade a seal section of an engine case.

20 Claims, 4 Drawing Sheets

Related U.S. Application Data which is a continuation of application No. 14/725,052, filed on May 29, 2015, now Pat. No. 9,932,839.

(60) Provisional application No. 62/007,647, filed on Jun. 4, 2014.

(52) U.S. Cl.
CPC ..... *F05D 2230/10* (2013.01); *F05D 2230/25* (2013.01); *F05D 2230/90* (2013.01); *F05D 2300/2112* (2013.01); *F05D 2300/22* (2013.01); *F05D 2300/2282* (2013.01); *F05D 2300/2284* (2013.01); *F05D 2300/30* (2013.01); *F05D 2300/506* (2013.01); *Y10T 29/49337* (2015.01)

(58) Field of Classification Search
CPC ..... F05D 2230/25; F05D 2230/90; F05D 2300/30; F05D 2300/2284; F05D 2300/22; F05D 2300/2112; F05D 2300/2282; Y10T 29/49337
See application file for complete search history.

(56) References Cited

U.S. PATENT DOCUMENTS 4,589,823 A 5/1986 Koffel
4,735,656 A * 4/1988 Schaefer ..... F01D 5/20 75/238
4,744,725 A 5/1988 Matarese et al.
4,851,188 A 7/1989 Schaefer et al.
4,957,411 A * 9/1990 Girault ..... F01D 5/20 415/173.4
5,104,293 A 4/1992 Eaton et al.
5,476,363 A 12/1995 Freling et al.
5,603,603 A * 2/1997 Benoit ..... F01D 11/12 415/173.4
5,756,217 A 5/1998 Schroder et al.
6,190,124 B1 2/2001 Freling et al.
8,807,955 B2 8/2014 Wrabel et al.
9,932,839 B2 * 4/2018 Guo ..... F01D 5/20
2007/0077149 A1 4/2007 Lejars et al.
2010/0329875 A1 12/2010 Kray et al.
2015/0354373 A1 12/2015 Guo et al.
2018/0223677 A1 8/2018 Guo et al.

OTHER PUBLICATIONS

Communication of European Search Report; Application No. 15170740.3-1610; dated Oct. 2, 2015; 48 pages.
EP Office Action for Application No. 15 170 740.0; dated Jan. 8, 2020.
European Search Report for Application No. 15170740.3-1610; dated Oct. 2, 2015; 7 pgs.
Office Action dated Mar. 31, 2017 incorresponding CN Patent Application No. 201510301455.1, 21 pages.

* cited by examiner

CUTTING BLADE TIPS

CROSS-REFERENCE TO RELATED APPLICATIONS

This application is a Continuation-in-Part of U.S. Non-Provisional application Ser. No. 15/943,431 filed on Apr. 2, 2018, which is a Continuation of U.S. Non-Provisional application Ser. No. 14/725,052, filed May 29, 2015, which claims the benefit of priority under 35 U.S.C. § 119(e) to U.S. Provisional Application No. 62/007,647, filed Jun. 4, 2014, the contents each of which are incorporated herein by reference thereto.

BACKGROUND

1. Field of the Disclosure

The present disclosure relates to blades, and more particularly to blade tip surfaces such as those for cooperating with abradable coatings on turbomachines, such as in gas turbine engines.

2. Description of Related Art

A variety of rotating blades are known for use in gas turbine engines. Traditionally, air seals are used between rotating blades and the inner surface of the engine case in order to increase engine efficiency. Engine efficiency can be correlated to the clearance between tips of the blades and the inner diameter of the air seal. In this regard, some air seals are provided as an abradable air seal that incorporates an abradable material affixed to the inner surface of a casing. During operation, the rotating blade tips of the blades contact and abrade the abradable material (also known as "rubbing").

Performance requirements for abradable air seal systems can include efficiency standards and maintenance cost targets, among other requirements. In order to meet these standards, abradable air seal systems can be required to have low gas permeability, low roughness, good erosion resistance, but still be abradable during interaction with blades. These requirements can conflict with one another, for example, typically the more erosion resistant an air seal is, the greater the increase in the density and hardness of the seal, tending to increase the difficulty of abrading such a seal. In order to cut the hard and dense abradable material, blades can include abrasive tip coatings such as Cubic Boron Nitride (CBN), which tends to increase the cost of the blades.

Such conventional methods and systems have generally been considered satisfactory for their intended purpose. However, there is still a need in the art for improved blades for use in sealing systems. The present disclosure provides solutions for these problems.

SUMMARY OF THE DISCLOSURE

A blade includes a blade body extending from a blade root to an opposed blade tip surface along a longitudinal axis. The blade body defines a pressure side and a suction side. The blade body includes a cutting edge defined where the tip surface of the blade body meets the pressure side of the blade body. The cutting edge is configured to abrade a seal section of an engine case.

The blade can include cutting points extending axially from the blade tip surface along the longitudinal axis. The blade can include a coating disposed on a portion of the blade tip surface. The coating can include TiN, TiCN, TiAlN, $Al_2O_3$, CBN, diamond, or the like. The coating can be disposed only on a portion of the blade tip surface that includes the cutting points, for example.

The blade tip surface can include a chamfered surface between the pressure side and the suction side of the blade body that tapers toward the blade root in a direction from the pressure side to the suction side. The blade tip surface can include a land on the blade tip surface between the pressure side and the chamfered surface. A portion of the land can be at a ninety degree angle with respect to a portion of the pressure side of the blade body. The cutting edge can define an arcuate portion transitioning between the pressure side and the land of the blade tip surface. The cutting points can be disposed only on the land of the blade tip surface. The cutting edge can include a projection portion. The projection portion can extend from the pressure side of the blade body.

A method for manufacturing a blade includes forming an airfoil with a root and an opposed tip surface along a longitudinal axis, wherein the airfoil defines a pressure side and a suction side. The method also includes forming a cutting edge where the tip surface of the airfoil meets the pressure side of the airfoil.

Forming a cutting edge can include machining a chamfered surface between the pressure side and the suction side on the tip surface, machining an arcuate portion between the pressure side and a land, and/or machining a projection portion extending from the pressure side. Machining a chamfered surface can include tapering the chamfered surface toward the root in a direction from the pressure side to the suction side.

Forming a cutting edge can include forging a chamfered surface between the pressure side and the suction side on the tip surface, forging an arcuate portion between the pressure side and a land, and/or forging a projection portion extending from the pressure side. Forging a chamfered surface can include tapering the chamfered surface toward the root in a direction from the pressure side to the suction side. The method can include forming cutting points in the tip surface. The method can also include coating a portion of the tip surface with a coating material including at least one of TiN, TiCN, TiAlN, $Al_2O_3$, CBN, and diamond.

A gas turbine engine includes a case defining a centerline axis, an abradable liner disposed radially inward from the case, a hub radially inward from the case and the abradable liner, and a plurality of blade bodies extending radially outward from the hub for rotation about the centerline axis. The abradable liner includes a layer of rub material disposed on an inner diameter of the abradable liner. The cutting edge of each blade body is positioned proximate an inner diameter of the layer of rub material for abrading the layer of rub material during circumferential movement of the cutting edges as the blade bodies rotate about the centerline axis.

Disclosed is an integrally bladed rotor, the integrally bladed rotor having: a plurality of blades integrally formed with a hub as a single component, each of the plurality of blades having a blade body extending from the hub to an opposed blade tip surface along a longitudinal axis, wherein the blade body defines a pressure side and a suction side, and wherein the blade body includes a cutting edge defined between the blade tip surface of the blade body and the pressure side of the blade body, wherein the cutting edge is configured to abrade a seal section of an engine case.

In addition to one or more of the features described above, or as an alternative to any of the foregoing embodiments, the integrally bladed rotor includes cutting points extending axially from the blade tip surface along the longitudinal axis.

In addition to one or more of the features described above, or as an alternative to any of the foregoing embodiments, a coating disposed on a portion of the blade tip surface, wherein the coating includes at least one of TiN, TiCN, TiAlN, $Al_2O_3$, CBN and diamond.

In addition to one or more of the features described above, or as an alternative to any of the foregoing embodiments, the coating is disposed only on a portion of the blade tip surface that includes the cutting points.

In addition to one or more of the features described above, or as an alternative to any of the foregoing embodiments, the blade tip surface includes a chamfered surface between the pressure side and the suction side of the blade body that tapers toward the blade root in a direction from the pressure side to the suction side.

In addition to one or more of the features described above, or as an alternative to any of the foregoing embodiments, the blade tip surface includes a land on the blade tip surface between the pressure side and the chamfered surface.

In addition to one or more of the features described above, or as an alternative to any of the foregoing embodiments, a portion of the land is at a ninety degree angle with respect to a portion of the pressure side of the blade body.

In addition to one or more of the features described above, or as an alternative to any of the foregoing embodiments, the cutting edge defines an arcuate portion transitioning between the pressure side and a land of the blade tip surface, wherein the land is between the pressure side and the chamfered surface.

In addition to one or more of the features described above, or as an alternative to any of the foregoing embodiments, cutting points extending axially from the blade tip surface along the longitudinal axis are disposed only on a land of the blade tip surface, wherein the land is on the blade tip surface between the pressure side and the chamfered surface.

In addition to one or more of the features described above, or as an alternative to any of the foregoing embodiments, the cutting edge includes a projection portion, wherein the projection portion extends from the pressure side of the blade body.

Also disclosed is a method for manufacturing an integrally bladed rotor including: forming a plurality of airfoils integrally with a hub to form a single component, each of the plurality of airfoils having an opposed tip surface with respect to the hub extending along a longitudinal axis, wherein each of the plurality of airfoils defines a pressure side and a suction side; and forming a cutting edge between the tip surface and the pressure side of each of the plurality of airfoils, wherein the cutting edge is configured to abrade a seal section of an engine case.

In addition to one or more of the features described above, or as an alternative to any of the foregoing embodiments, forming a cutting edge includes machining a chamfered surface on the tip surface between the pressure side and the suction side, wherein machining a chamfered surface includes tapering the chamfered surface toward the hub in a direction from the pressure side to the suction side.

In addition to one or more of the features described above, or as an alternative to any of the foregoing embodiments, forming a cutting edge includes machining an arcuate portion between the pressure side and a land, wherein the land is surface on the tip surface between the pressure side and a chamfered surface, wherein the chamfered surface is on the tip surface between the pressure side and the suction side.

In addition to one or more of the features described above, or as an alternative to any of the foregoing embodiments, forming a cutting edge includes machining a projection portion extending from the pressure side.

In addition to one or more of the features described above, or as an alternative to any of the foregoing embodiments, forming a cutting edge includes forging a chamfered surface between the pressure side and the suction side, wherein forging a chamfered surface includes tapering the chamfered surface toward the hub in a direction from the pressure side to the suction side.

In addition to one or more of the features described above, or as an alternative to any of the foregoing embodiments, forming a cutting edge includes forging an arcuate portion between the pressure side and a land, wherein the land is surface on the tip surface between the pressure side and a chamfered surface, wherein the chamfered surface is on the tip surface between the pressure side and the suction side.

In addition to one or more of the features described above, or as an alternative to any of the foregoing embodiments, forming a cutting edge includes forging a projection portion extending from the pressure side.

In addition to one or more of the features described above, or as an alternative to any of the foregoing embodiments, further comprising forming cutting points in the tip surface, wherein the cutting points extend axially from the tip surface along the longitudinal axis.

In addition to one or more of the features described above, or as an alternative to any of the foregoing embodiments, coating a portion of the tip surface with a coating material including at least one of TiN, TiCN, TiAlN, $Al_2O_3$, CBN and diamond.

Also disclosed is a gas turbine engine, the gas turbine engine having: a case defining a centerline axis; an abradable liner disposed radially inward from the case including a layer of rub material disposed on an inner diameter of the abradable liner; an integrally bladed rotor having a hub radially inward of the case and the abradable liner; and a plurality of blade bodies integrally formed with the hub as a single component and extending radially outward from the hub for rotation about the centerline axis, wherein each blade body extends from the hub to an opposed respective blade tip surface along a respective longitudinal axis, wherein each blade body defines a respective pressure side and a respective suction side, wherein each blade body includes a respective cutting edge defined between the blade tip surface and the pressure side of the blade body, wherein the cutting edge of each blade body is positioned proximate an inner diameter of the layer of rub material for abrading the layer of rub material during circumferential movement of the cutting edges as the blade bodies rotate about the centerline axis.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
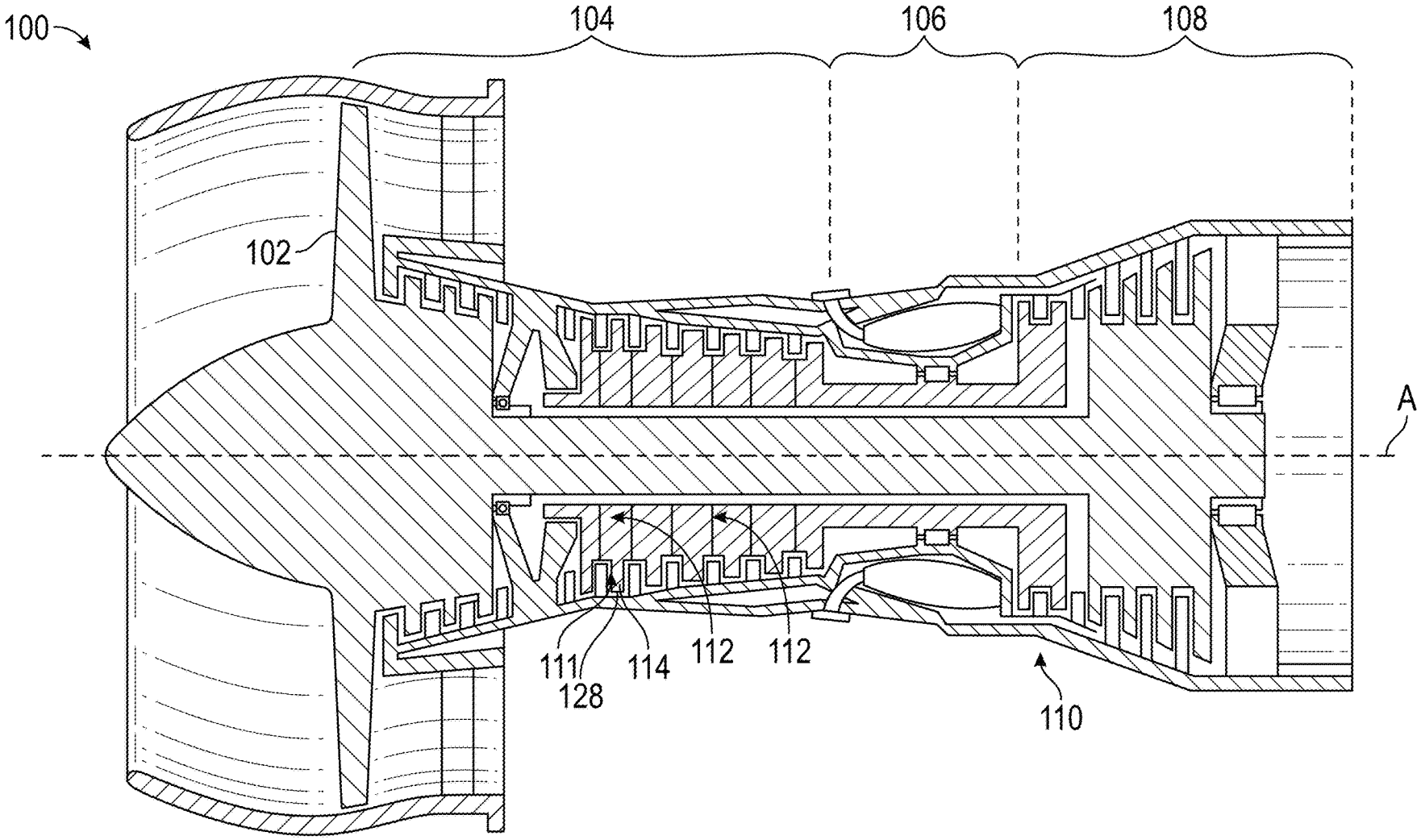
FIG. 1 is a schematic diagram depicting an exemplary embodiment of a gas turbine engine with an integrally bladed rotor constructed in accordance with the present disclosure.
Figure 2:
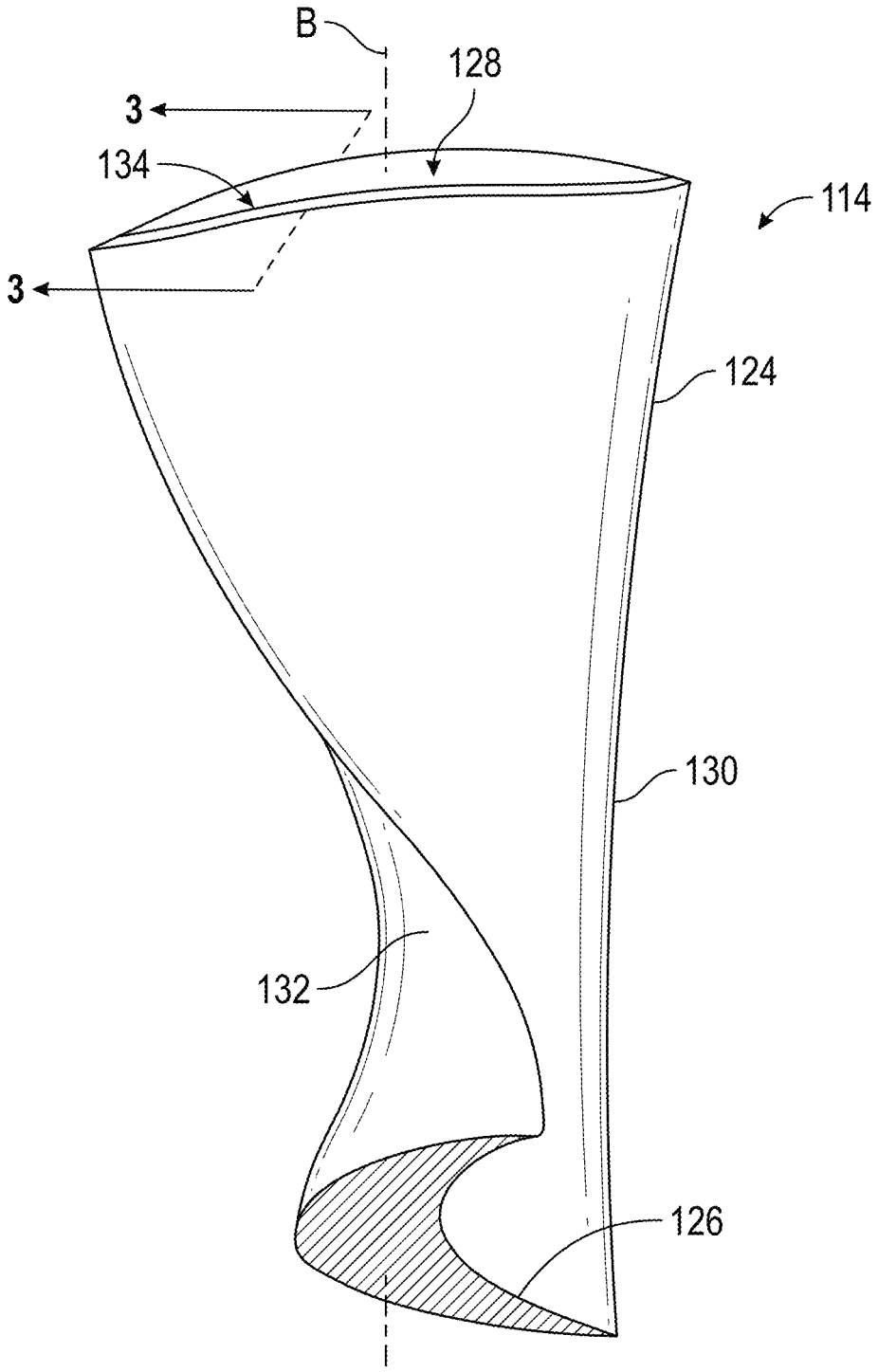
FIG. 2 is a schematic perspective view of an exemplary embodiment of a blade of the integrally bladed rotor constructed in accordance with the present disclosure, showing a pressure side of the blade and a cutting edge.

Reference will now be made to the drawings wherein like reference numerals identify similar structural features or aspects of the subject disclosure. For purposes of explanation and illustration, and not limitation, a partial view of an exemplary embodiment of a gas turbine engine in accordance with the disclosure is shown in FIG. 1 and is designated generally by reference character 100. An enlarged perspective view of an exemplary embodiment of a gas turbine blade in accordance with the disclosure is shown in FIG. 2. Other embodiments of gas turbine blades in accordance with the disclosure, or aspects thereof, are provided in FIGS. 3-6, as will be described. The systems and methods described herein can be used to enable blades, e.g. nickel blades with or without any coating, to be used in abradable seal systems for gas turbine engines.

FIG. 1 schematically shows a gas turbine engine 100 including (in serial flow communication) a fan 102, a compressor 104, a combustor 106, and a turbine 108. Gas turbine engine 100 is circumferentially disposed about an engine centerline axis A. Gas turbine engine 100 includes an engine case 110 and an integrally bladed rotor 111 having a hub 112 with a plurality of blades 114 radially inward from case 110. The plurality of blades 114 being integrally formed with the hub 112 in order to form a single component, the plurality of blades projecting integrally and radially outward from hub 112 for rotation about centerline axis A.

Figure 3:
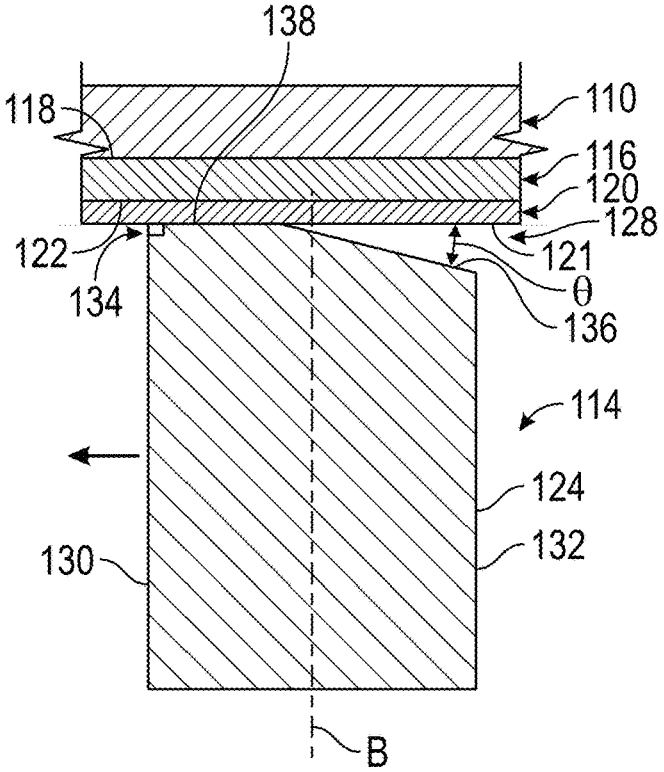
FIG. 3 is a schematic cross-sectional view of a portion of the blade shown in FIG. 2 disposed in the a gas turbine engine of FIG. 1, showing the cutting edge proximate to an abradable liner.

Now with reference to FIGS. 2 and 3, blade 114 of the integrally bladed rotor 111 includes a blade body 124 integrally formed with the hub 112 and radially extends from the hub 112 to a blade tip surface 128 along a longitudinal axis B. Blade body 124 defines a pressure side 130 and a suction side 132. Blade body 124 includes a cutting edge 134 defined between tip surface 128 of blade body 124 and pressure side 130 of blade body 124. Cutting edge 134 is configured to abrade a portion of an abradable liner 116, e.g. a seal section, of case 110. Those skilled in the art will readily appreciate that cutting edge 134 acts similar to a cutting edge of a cutting machine tool. Instead of removing abradable liner 116 material with friction wear, abradable liner 116 material is removed by the cutting action of cutting edge 134. It is contemplated that the reduced friction energy consumption as compared with traditional blades tends to reduce heat generation during rubbing of abradable liner 116 and improves the life of the integrally bladed rotor 111.

Those skilled in the art will also readily appreciate that blade 114 tends to reduce costs as compared with CBN tipped blades used in traditional seal systems because no CBN tipping is required for blade 114. In addition, it is contemplated that blade 114 can rub harder abradable layers, e.g. abradable liner 116, than traditional CBN tipped blades, therein increasing efficiency and engine performance, notably in the high-pressure compressor (HPC) section 104 of gas turbine 100. The pressure and temperature are higher in HPC section 104 therefore any clearance/gap reduction typically have a higher impact on efficiency improvements. In addition, in HPC section 104, abradables with high temperature capability, such as nickel and cobalt based materials, are often needed which tend to make it harder to abrade than other abradables found in other turbine sections.

As shown in FIG. 3, abradable liner 116 is located between the blade 114 and an inner surface 118 of engine case 110. Abradable liner 116 includes a layer of rub material 120 disposed on an inner diameter 122 of abradable liner 116. Blade tip surface 128 includes a chamfered surface 136 between pressure side 130 and suction side 132 of blade body 124 that tapers toward the hub 112 in a direction from pressure side 130 to suction side 132. The chamfered surface 136 reduces the width of contact of the blade tip surface 128 with the rub material 120. Blade tip surface 128 includes a land 138 between pressure side 130 and chamfered surface 136. A portion of land 138 is at a ninety degree angle with respect to a portion of pressure side 130. Those skilled in the art will readily appreciate that while the angle between land 138 and pressure side 130 is shown and described herein as approximately ninety degrees, the angle can vary depending on the application. For example, a smaller angle tends to increase cutting capability, but there may be a trade-off of reduced cutting edge strength. Those skilled in the art will readily appreciate that a relief angle θ between land 138 and chamfered surface 136 can range from 2 to 6 degrees. Relief angle θ reduces the contact between blade tip surface 128 and abradable liner 116, tending to reduce friction force and frictional heat generation as compared to traditional blades.

With continued reference to FIG. 3, cutting edge 134 of blade body 124 is positioned proximate an inner diameter 121 of layer of rub material 120 for abrading layer of rub material 120 during circumferential movement of cutting edge 134 as blade body 124 rotates about centerline axis A, shown in FIG. 1, as indicated schematically by the arrow.

Figure 4:
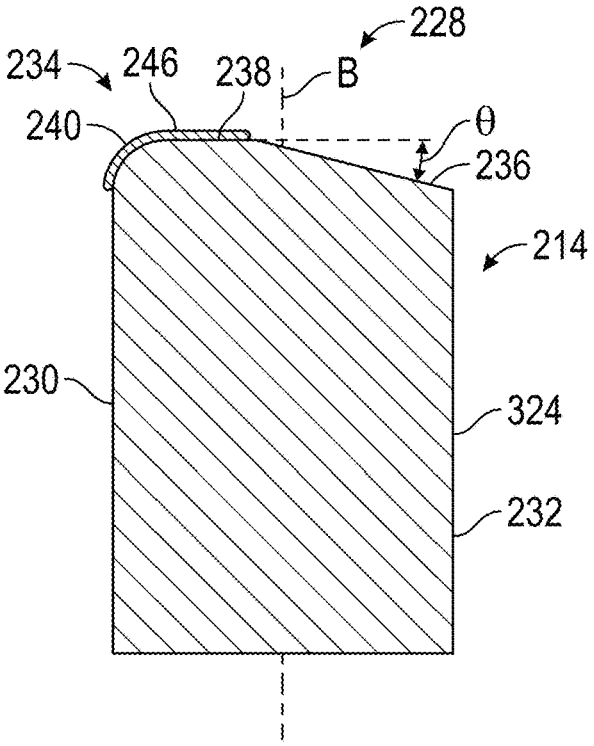
FIG. 4 is a schematic cross-sectional view of a portion of another exemplary embodiment of a blade of an integrally bladed rotor with a cutting edge constructed in accordance with the present disclosure, showing an arcuate portion on the blade tip surface with a coating.

As shown in FIG. 4, blade 214 is similar to blade 114. Cutting edge 234 of blade 214 defines an arcuate portion 240 transitioning between pressure side 230 and land 238 of blade tip surface 228. Blade tip surface 228 also includes a coating 246, described in further detail below. Those skilled in the art will readily appreciate that arcuate portion 240 can be stronger than a sharp cutting edge, but there may be a trade-off of increased frictional forces and higher energy tending to cause increased heat generation.

Figure 5:
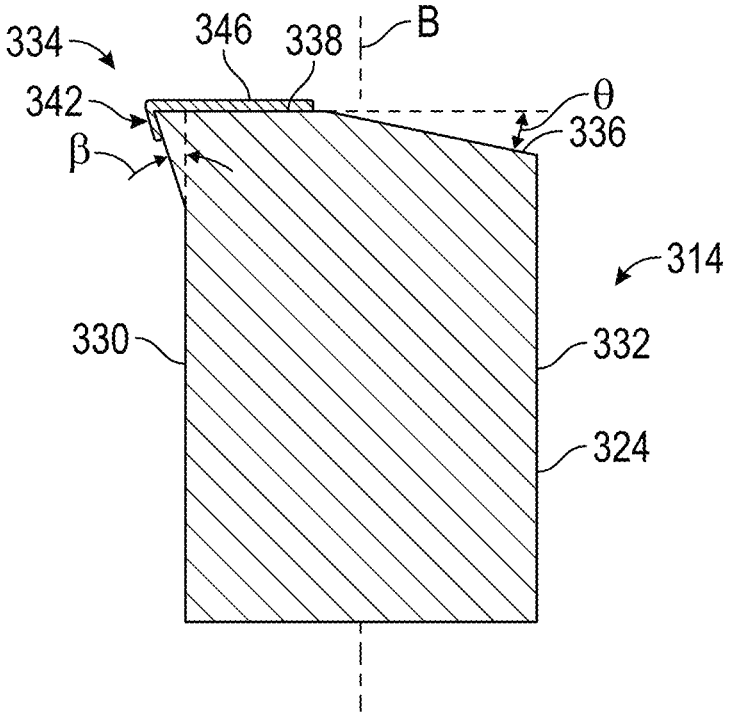
FIG. 5 is a schematic cross-sectional view of a portion of another exemplary embodiment of a blade of an integrally bladed rotor with a cutting edge constructed in accordance with the present disclosure, showing a projection portion on the blade tip surface with a coating.

Now with reference to FIG. 5, blade 314 is similar to blade 114. Cutting edge 334 of blade 314 includes a projection portion 342. Projection portion 342 extends from pressure side 330 of blade body 324, e.g. extending left as oriented in FIG. 5. An angle β between pressure side 330 and projection portion 342, e.g. rake angle, can range from 0 to 4 degrees, and/or can be a variety of suitable angles depending on the given application. For example, the larger angle β is, the sharper and more efficient cutting edge 334 can be, tending to require less force to cut through an abradable liner, e.g. abradable liner 116, but there may be a trade-off of reduced cutting edge 334 strength. Blade tip surface 328 also includes a coating 346, described in further detail below.

Figure 6:
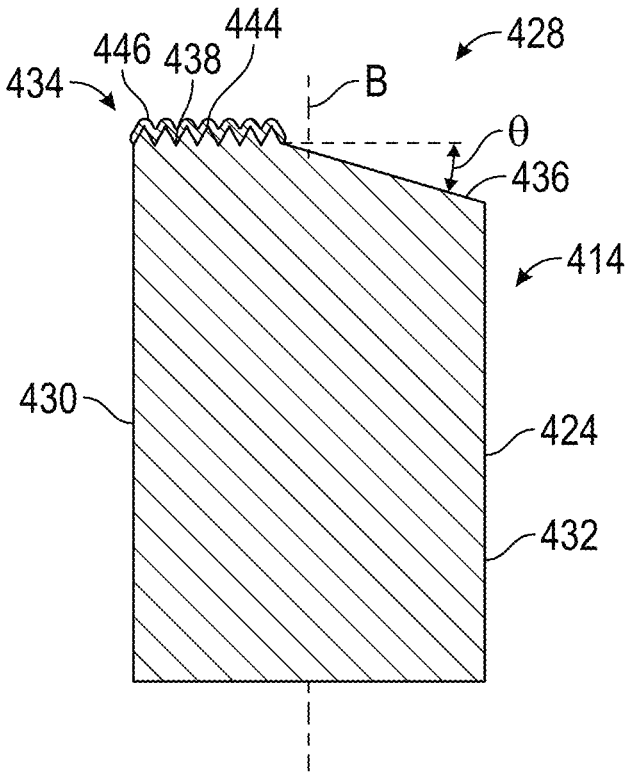
FIG. 6 is a schematic cross-sectional view of a portion of another exemplary embodiment of a blade of an integrally bladed rotor with a cutting edge constructed in accordance with the present disclosure, showing cutting points dispose on a portion of the blade tip surface with a coating.

As shown in FIG. 6, blade 414 is substantially similar to blade 114. Blade 414 includes asperities or raised material such as cutting points 444 extending axially from blade tip surface 428 along longitudinal axis B. Cutting points are disposed on land 438 of blade tip surface 428. Those skilled in the art will readily appreciate that cutting points 444 can also be disposed on lands 138, 238 and 338 of blades 114, 214 and 314, respectively. Those skilled in the art will readily appreciate that the reduced surface area contact between cutting points 444 and an abradable liner, e.g. abradable liner 116, as compared to the surface area contact between the abradable liner a blade tip surface 428 without cutting points 444, tends to reduce heat generation.

With reference now to FIGS. 3-6, blades 214, 314 and 414 include a coating 246, 346 and 446 disposed on a portion of blade tip surfaces 228, 328, and 428. The coating 246, 346 and 446 may be a hard anodize or thin film coating that does cover the entire portion of blade tip surfaces 228, 328, and 428. The coating 246, 346 and 446 may be disposed only on the cutting edge 134, 234, 334, and 434. In at least one embodiment, the coating 246, 346 and 446 may be disposed on a thin area between blade tip surface 128, 228, 328, and 428 and pressure side 130, 230, 330, and 430 and be provided instead of the cutting edge.

The coating 246, 346, and 446 can include abrasive particles or an abrasive grit, retained in a matrix material. The abrasive particles or abrasive grit may extend above or beyond the matrix material reducing the contact area to reduce the cutting load and heat between the cutting features and the abradable liner 116 therefore improving the life of the blades of the integrally bladed rotor. The abrasive particles can include abrasive grit, TiN, TiCN, TiAlN, aluminum oxide, $Al_2O_3$, carbide particles, diamond, CBN and/or any other suitable coating for machining high strength aerospace alloys. Those skilled in the art will readily appreciate that the CBN coating varies from CBN abrasive tipping in that the CBN abrasives are typically brazed or plated on the tips of the blades, while the CBN coating is a thin layer, in the range of microns, on the blade tip, similar to a coated cutting tool edge. Coatings 246, 346 and 446 tend to reduce the wearing away of blade material, e.g. a nickel alloy material, during rubbing. As shown in FIG. 6, coating 446 is disposed only on a portion of blade tip surface 428 that includes cutting points 444. Those skilled in the art will readily appreciate that, while blade 414 is shown with coating 446 only on cutting points 444, coating 446 can be applied directly to a cutting edge, e.g. cutting edge 134, of a blade, e.g. blade 114, similar to coatings 246 and 346 shown in FIGS. 4 and 5. It is also contemplated that other suitable coatings can be applied to blade tip surfaces 128, 228, 328 and 428 depending on where blades 114, 214, 314 and 414 are being used in the turbine engine.

With reference now to FIGS. 1-6, a method for manufacturing an integrally bladed rotor, e.g. blades 114, 214, 314 and 414 extending from hub 112, includes forming an airfoil, e.g. blade bodies 124, 224, 324 and 424, extending from the hub 112 towards an opposed tip surface, e.g. tip surfaces 128, 228, 328 and 428, along a longitudinal axis, e.g. longitudinal axis B, wherein the airfoil defines a pressure side, e.g. pressure sides 130, 230, 330 and 430, and a suction side, e.g. suction sides 132, 232, 332 and 432, and forming a cutting edge, e.g. cutting edges 134, 234, 334 and 434, between the tip surface of the airfoil and the pressure side of the airfoil. The cutting edge is configured to abrade a seal section, e.g. abradable liner 116, of an engine case, e.g. engine case 110.

Those skilled in the art will readily appreciate that forming the cutting edge can include either machining or forging a chamfered surface, e.g. chamfered surfaces 136, 236, 336 and 436, between the pressure side and the suction side. Machining and/or forging the chamfered surface includes tapering the chamfered surface toward the blade root in a direction from the pressure side to the suction side. It is also contemplated that forming the cutting edge can include machining and/or forging an arcuate portion, e.g. arcuate portion 240, between the pressure side and a land. Further, those skilled in the art will also readily appreciate that forming the cutting edge can include machining and/or forging a projection portion, e.g. projection portion 342, extending from the pressure side.

In addition, it is contemplated that the method can include forming cutting points, e.g. cutting points 444, in the tip surface. Those skilled in the art will readily appreciate that the cutting points can be formed by machining, knurling or any other suitable manufacturing process. It is contemplated that the method can also include coating a portion of the tip surface with a coating material including at least one of TiN, TiCN, TiAlN, $Al_2O_3$, CBN and diamond. Those skilled the art will readily appreciate that physical vapor deposition (PVD) and/or chemical vapor deposition (CVD) can be used to deposit the coatings, e.g. coatings 146, 246, 346 and 446, described above. It is contemplated that the methods described herein are suitable for mass production of the integrally bladed rotor disk.

The methods and systems of the present disclosure, as described above and shown in the drawings, provide for blades with superior properties including increased efficiency and potentially reduced cost. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. An integrally bladed rotor, comprising:

a plurality of blades integrally formed with a hub as a single component, each of the plurality of blades having a blade body extending from the hub to an opposed blade tip surface along a longitudinal axis, wherein the blade body defines a pressure side and a suction side, and wherein the blade body includes a cutting edge defined between the blade tip surface of the blade body and the pressure side of the blade body, wherein the cutting edge is configured to abrade a seal section of an engine case.

2. The integrally bladed rotor as in claim 1, further comprising cutting points extending axially from the blade tip surface along the longitudinal axis.

3. The integrally bladed rotor as in claim 2, further comprising a coating disposed on a portion of the blade tip surface, wherein the coating includes at least one of TiN, TiCN, TiAlN, $Al_2O_3$, CBN and diamond.

4. The integrally bladed rotor as in claim 3, wherein the coating is disposed only on a portion of the blade tip surface that includes the cutting points.

5. The integrally bladed rotor as in claim 1, wherein the blade tip surface includes a chamfered surface between the pressure side and the suction side of the blade body that tapers toward a root of the blade in a direction from the pressure side to the suction side.

6. The integrally bladed rotor as in claim 5, wherein the blade tip surface includes a land on the blade tip surface between the pressure side and the chamfered surface.

7. The integrally bladed rotor as in claim 6, wherein a portion of the land is at a ninety degree angle with respect to a portion of the pressure side of the blade body.

8. The integrally bladed rotor as in claim 5, wherein the cutting edge defines an arcuate portion transitioning between the pressure side and a land of the blade tip surface, wherein the land is between the pressure side and the chamfered surface.

9. The integrally bladed rotor as in claim 5, wherein cutting points extending axially from the blade tip surface along the longitudinal axis are disposed only on a land of the blade tip surface, wherein the land is on the blade tip surface between the pressure side and the chamfered surface.

10. The integrally bladed rotor as in claim 1, wherein the cutting edge includes a projection portion, wherein the projection portion extends from the pressure side of the blade body.

11. A method for manufacturing an integrally bladed rotor, the method comprising:

forming a plurality of airfoils integrally with a hub to form a single component, each of the plurality of airfoils having an opposed tip surface with respect to the hub extending along a longitudinal axis, wherein each of the plurality of airfoils defines a pressure side and a suction side; and forming a cutting edge between the tip surface and the pressure side of each of the plurality of airfoils, wherein the cutting edge is configured to abrade a seal section of an engine case.

12. The method as recited in claim 11, wherein forming a cutting edge includes machining a chamfered surface on the tip surface between the pressure side and the suction side, wherein machining a chamfered surface includes tapering the chamfered surface toward the hub in a direction from the pressure side to the suction side.

13. The method as recited in claim 11, wherein forming a cutting edge includes machining an arcuate portion between the pressure side and a land, wherein the land is surface on the tip surface between the pressure side and a chamfered surface, wherein the chamfered surface is on the tip surface between the pressure side and the suction side.

14. The method as recited in claim 11, wherein forming a cutting edge includes machining a projection portion extending from the pressure side.

15. The method as recited in claim 11, wherein forming a cutting edge includes forging a chamfered surface between the pressure side and the suction side, wherein forging a chamfered surface includes tapering the chamfered surface toward the hub in a direction from the pressure side to the suction side.

16. The method as recited in claim 11, wherein forming a cutting edge includes forging an arcuate portion between the pressure side and a land, wherein the land is surface on the tip surface between the pressure side and a chamfered surface, wherein the chamfered surface is on the tip surface between the pressure side and the suction side.

17. The method as recited in claim 11, wherein forming a cutting edge includes forging a projection portion extending from the pressure side.

18. The method as recited in claim 11, further comprising forming cutting points in the tip surface, wherein the cutting points extend axially from the tip surface along the longitudinal axis.

19. The method as recited in claim 11, further comprising coating a portion of the tip surface with a coating material including at least one of TiN, TiCN, TiAlN, $Al_2O_3$, CBN and diamond.

20. A gas turbine engine comprising:

a case defining a centerline axis;

an abradable liner disposed radially inward from the case including a layer of rub material disposed on an inner diameter of the abradable liner;

an integrally bladed rotor having a hub radially inward of the case and the abradable liner; and a plurality of blade bodies integrally formed with the hub as a single component and extending radially outward from the hub for rotation about the centerline axis, wherein each blade body extends from the hub to an opposed respective blade tip surface along a respective longitudinal axis, wherein each blade body defines a respective pressure side and a respective suction side, wherein each blade body includes a respective cutting edge defined between the blade tip surface and the pressure side of the blade body, wherein the cutting edge of each blade body is positioned proximate an inner diameter of the layer of rub material for abrading the layer of rub material during circumferential movement of the cutting edges as the blade bodies rotate about the centerline axis.

* * * * *